US010665216B2

(12) United States Patent
Maezawa

(10) Patent No.: US 10,665,216 B2
(45) Date of Patent: May 26, 2020

(54) CONTROL METHOD AND CONTROLLER

(71) Applicant: Yamaha Corporation, Hamamatsu-shi, Shizuoka-Ken (JP)

(72) Inventor: Akira Maezawa, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 16/247,717

(22) Filed: Jan. 15, 2019

(65) Prior Publication Data

US 2019/0147837 A1 May 16, 2019

Related U.S. Application Data

(63) Continuation of application No. PCT/JP2017/026525, filed on Jul. 21, 2017.

(30) Foreign Application Priority Data

Jul. 22, 2016 (JP) ..... 2016-144349

(51) Int. Cl.
*G10H 1/00* (2006.01)
*G10G 3/04* (2006.01)

(52) U.S. Cl.
CPC ..... *G10H 1/0008* (2013.01); *G10G 3/04* (2013.01); *G10H 1/00* (2013.01); *G10H 2210/061* (2013.01); *G10H 2210/066* (2013.01)

(58) Field of Classification Search
CPC ..... G10H 1/0008; G10H 2210/066; G10H 2210/061; G10H 1/00; G10G 3/04
USPC ..... 84/609
See application file for complete search history.

(56) References Cited

U.S. PATENT DOCUMENTS 5,652,403 A * 7/1997 Sugiyama ..... G10H 1/344 84/708
6,979,769 B1 * 12/2005 Majima ..... G10H 1/0066 434/307 A
7,863,513 B2 * 1/2011 Ishii ..... G10H 1/0041 84/645
8,680,388 B2 * 3/2014 Becker ..... G10H 1/00 84/609

(Continued)

FOREIGN PATENT DOCUMENTS

JP 2007-241181 A 9/2007
JP 2015-36710 A 2/2015

(Continued)

OTHER PUBLICATIONS

International Search Report (PCT/ISA/210) issued in PCT Application No. PCT/JP2017/026525 dated Oct. 17, 2017 with English translation (four (4) pages).

(Continued)

*Primary Examiner* — Jeffrey Donels
(74) *Attorney, Agent, or Firm* — Crowell & Moring LLP

(57) ABSTRACT

A control method includes: detecting a first sound signal from a musical instrument through a sensor arranged by the musical instrument; receiving a result of detection related to a first event in music performance; determining a tracking coefficient that indicates how closely a second event follows the first event in the music performance; determining an operation mode of the second event based on the tracking coefficient; and outputting the music from the automated musical instrument based on the operation mode.

18 Claims, 4 Drawing Sheets

(56) References Cited

U.S. PATENT DOCUMENTS

| | | | | |
|---|---|---|---|---|
| 2001/0015122 | A1 | 8/2001 | Yamada | |
| 2003/0024375 | A1* | 2/2003 | Sitrick | G09B 15/002 84/477 R |
| 2003/0133700 | A1* | 7/2003 | Uehara | G10H 1/368 386/240 |
| 2003/0177890 | A1* | 9/2003 | Furukawa | G10H 1/0041 84/610 |
| 2004/0177747 | A1* | 9/2004 | Tsuji | G10H 1/0066 84/645 |
| 2015/0013533 | A1 | 1/2015 | Buskies et al. | |

FOREIGN PATENT DOCUMENTS

| | | | |
|---|---|---|---|
| JP | 2015-45731 | A | 3/2015 |
| JP | 2015-79183 | A | 4/2015 |

OTHER PUBLICATIONS

Japanese-language Written Opinion (PCT/ISA/237) issued in PCT Application No. PCT/JP2017/026525 dated Oct. 17, 2017 (four (4)pages).

English translation (Japanese-language Written Opinion (PCT/ISA/237) previously filed on Jan. 15, 2019) issued in PCT Application No. PCT/JP2017/026525 dated Oct. 17, 2017 (six pages).

Japanese-language Office Action issued in counterpart Japanese Application No. 2018-528901 dated Nov. 12, 2019 with English translation (seven pages).

Extended European Search Report issued in European Application No. 17831153.6 dated Mar. 6, 2020 (nine (9) pages).

* cited by examiner

CONTROL METHOD AND CONTROLLER

CROSS REFERENCE TO RELATED APPLICATIONS

This application is a Continuation application of PCT Application No. PCT/JP2017/026525, filed Jul. 21, 2017, and is based on and claims priority from Japanese Patent Application No. 2016-144349, filed Jul. 22, 2016, the entire contents of each of which are incorporated herein by reference.

TECHNICAL FIELD

The present disclosure relates to a control method and to a controller.

BACKGROUND ART

There is known in the art a technique by which in a music score a position being played by a player is estimated based on sound signals indicative of a sound output in the performance (e.g., Patent Document 1).

RELATED ART DOCUMENT

Patent Document

Patent Document 1: Japanese Patent Application Laid-Open Publication No. 2015-79183

In an ensemble system in which a player and an automated musical instrument, etc. play music together, processing is executed to predict, for example, a timing of an event in which the automated musical instrument outputs a subsequent sound based on a result of estimating a position in the music score currently being played by the player.

A control method in accordance with some embodiments includes: detecting a first sound signal from a musical instrument through a sensor arranged by the musical instrument; receiving a result of detection related to a first event, in which the first sound signal is output by the musical instrument played by a musician, in a music performance; determining a tracking coefficient that indicates how closely a second event, in which a second sound signal is output by an automated musical instrument, follows the first event in the music performance; determining an operation mode, for outputting music from the automated musical instrument, of the second event based on the tracking coefficient; and outputting the music from the automated musical instrument based on the operation mode.

A controller in accordance with some embodiments includes: a sensor arranged by a musical instrument that detects a first sound signal from the musical instrument; a receiver configured to receive a result of detection related to a first event, in which the first sound signal is output by the musical instrument played by a musician, in a music performance; a coefficient determiner configured to determine a tracking coefficient that indicates how closely a second event, in which a second sound signal is output by an automated musical instrument, follows the first event in the music performance; and an operation determiner configured to determine an operation mode, for outputting music from the automated musical instrument, of the second event based on the tracking coefficient; wherein the music is output by the automated musical instrument based on the operation mode.

DESCRIPTION OF THE EMBODIMENTS

1. Configuration

Figure 1:
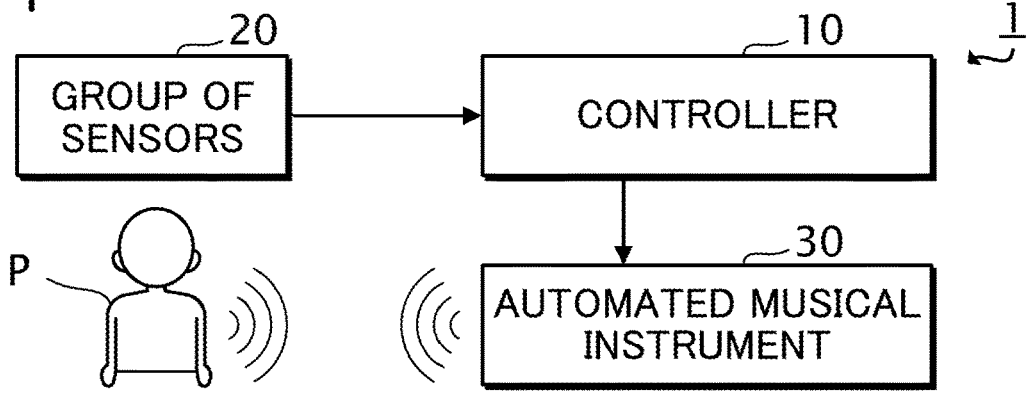
FIG. 1 is a block diagram of an ensemble system 1 in accordance with one or more embodiment.

FIG. 1 is a block diagram showing a configuration of an ensemble system 1 in accordance with one or more embodiments. The ensemble system 1 is a system that enables a human player P and an automated musical instrument 30 to play music together. In other words, using the ensemble system 1, the automated musical instrument 30 plays music in tune with music played by the player P. The ensemble system 1 includes a controller 10, a group of sensors 20, and the automated musical instrument 30. In the present embodiment, it is assumed that the player P and the automated musical instrument 30 play together a known piece of music. That is, the controller 10 stores music data indicative of a music score of the music piece that the player P and the automated musical instrument 30 play together.

The player P plays a musical instrument. The group of sensors 20 detects information related to a music performance of the player P. In this embodiment, the group of sensors 20 includes, for example, a microphone placed in front of the player P. The microphone collects sound output from the musical instrument played by the player P, and converts the collected sound into a sound signal and outputs the sound signal.

The controller 10 controls timings with which the automated musical instrument 30 plays music in a manner in which the music played by the automated musical instrument 30 follows music played by the player P. Based on sound signals provided by the group of sensors 20, the controller 10 executes the following three processes: (1) estimation of a position in a music score that is currently being played (hereafter, may be referred to as "estimation of a performance position"); (2) prediction of a time (timing) at which a subsequent sound is to be output by the automated musical instrument 30 playing music (hereafter, may be referred to as "prediction of a sound output time"); and (3) output of a performance instruction to the automated musical instrument 30 (hereafter, may be referred to as "output of a performance instruction"). Here, the estimation of a performance position is a process for estimating a position in the music score, that is being played together by the player P and the automated musical instrument 30. The prediction of a sound output time is a process for predicting a time at which the automated musical instrument 30 outputs a subsequent sound, based on a result of the estimation of the performance position. The output of a performance instruction is a process for outputting a performance instruction directed to the automated musical instrument 30 in accordance with the predicted sound output time. Output of sound by the player P during his/her performance is an example of a "first event", and output of sound by the automated musical instrument 30 during its performance is an example of a "second event". In the following description, the first event and the second event may generally be referred to as "events".

The automated musical instrument 30 is a musical instrument that is capable of playing music without human operation, in accordance with performance instructions provided by the controller 10. An example of the automated musical instrument 30 is a self-playing piano.

Figure 2:
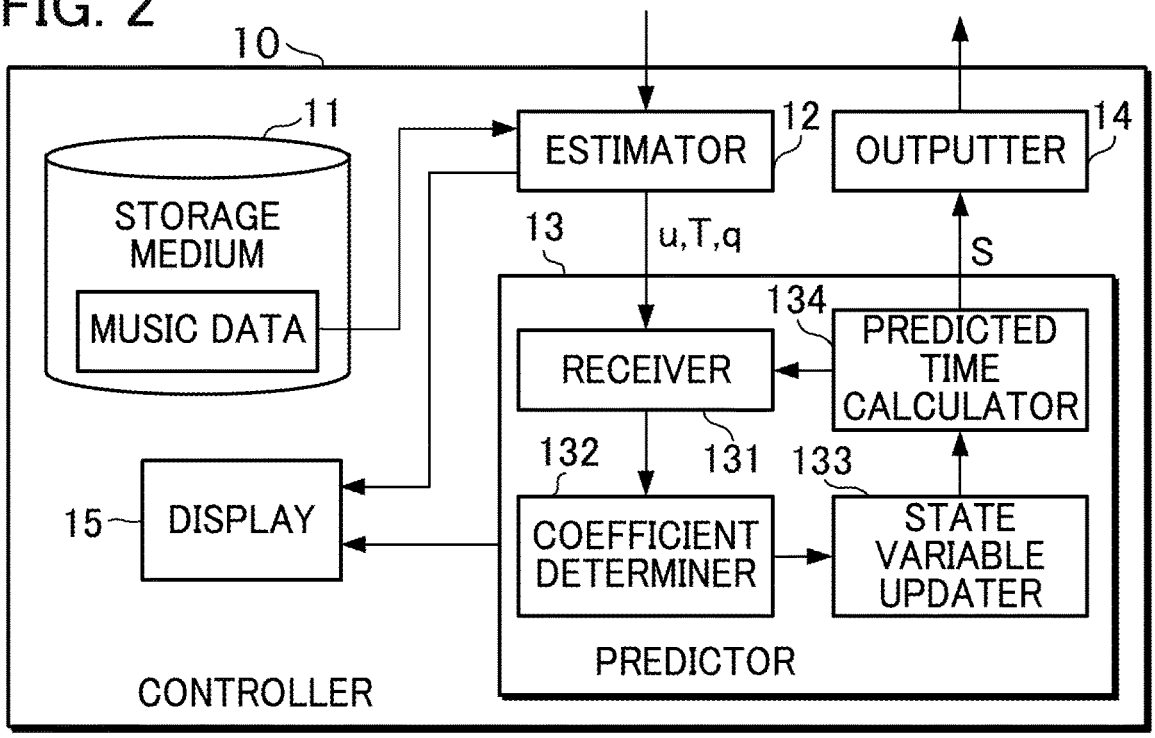
FIG. 2 is a functional block diagram of a controller 10.

FIG. 2 is a block diagram showing an exemplary functional configuration of the controller 10. The controller 10 includes a storage medium 11, an estimator 12, a predictor 13, an outputter 14, and a display 15.

The storage medium 11 stores various data. In this example, the storage medium 11 stores music data. The music data includes at least information that indicates output timings and pitches of sound specified in the music score. The output timings of sound indicated by the music data are expressed on the basis of, for example, a time unit (e.g., a thirty-second note) set for the music score. In addition to output timings and pitches of sound specified in the music score, the music data may also include information indicating at least one of length, tone, or volume of sound specified in the music score. For example, music data may be data in a MIDI (Musical Instrument Digital Interface) format.

The estimator 12 analyzes a sound signal input thereto, and estimates a position that is currently being played in the music score. The estimator 12 first extracts information of an onset time (sound output start time) and of pitches from the sound signal. Next, the estimator 12 calculates from the extracted information a probabilistic estimated value indicative of a position currently being played in the music score. The estimator 12 outputs the estimated value obtained by the calculation.

In this embodiment, estimated values output by the estimator 12 include a sound output position u, an observation noise q, and a sound output time T. The sound output position u is a position (e.g., the second beat in the fifth bar) in the music score, that corresponds to sound output during performance of either the player P or the automated musical instrument 30. The observation noise q is an observation noise (probabilistic fluctuation) of the sound output position u. The sound output position u and the observation noise q are expressed, for example, on the basis of the time unit set for the music score. The sound output time T is a time (a position along a time axis) at which output of sound is observed during performance of the player P. In the following description, a sound output position that corresponds to a note whose sound is the n-th to be output during performance of music is expressed as u[n] (n is a natural number satisfying $n \geq 1$). Other estimated values are similarly expressed.

The predictor 13, by using the estimated values provided by the estimator 12 as observation values, predicts a time at which a subsequent sound is to be output during the performance of the automated musical instrument 30 (prediction of a sound output time is executed). In this embodiment, an exemplary case is assumed in which the predictor 13 executes prediction of a sound output time using a so-called Kalman filter.

In the following, prediction of a sound output time according to related arts is described, before description is given of prediction of a sound output time according to this embodiment. More specifically, as a prediction of a sound output time according to the related arts, prediction of a sound output time using a regression model, and prediction of a sound output time using a dynamic model, are described.

First, prediction of a sound output time using a regression model is described, from among techniques for prediction of a sound output time according to related arts.

The regression model is a model that estimates a subsequent sound output time by using histories of sound output times for the player P and the automated musical instrument 30. The regression model is expressed by the following equation (1), for example.

$$S[n+1] = G_n \begin{pmatrix} S[n] \\ S[n-1] \\ \vdots \\ S[n-j] \end{pmatrix} + H_n \begin{pmatrix} u[n] \\ u[n-1] \\ \vdots \\ u[n-j] \end{pmatrix} + \alpha_n \tag{1}$$

Here, a sound output time S[n] is a sound output time for the automated musical instrument 30. A sound output position u[n] is a sound output position for the player P. In the regression model shown in equation (1), it is assumed that prediction of a sound output time is executed using "j+1" observation values (j is a natural number satisfying $1 \leq j < n$). In the description regarding the regression model shown in equation (1), it is assumed that a performance sound output by the player P and a performance sound output by the automated musical instrument 30 are distinguishable. The matrix $G_n$ and the matrix $H_n$ are matrices corresponding to regression coefficients. The subscript n shown in the matrix $G_n$, the matrix $H_n$, and the coefficient $a_n$ indicates that the matrix $G_n$, the matrix $H_n$, and the coefficient $a_n$ are elements that correspond to a note that is the n-th to have been played. Thus, in a case where the regression model shown in equation (1) is used, the matrix $G_n$, the matrix $H_n$, and the coefficient $a_n$ can be set to correspond one-to-one with notes included in the music score of a music piece. In other words, the matrix $G_n$, the matrix $H_n$, and the coefficient $a_n$ can be set in accordance with the position in the music score. In this way, the regression model shown in equation (1) enables prediction of a sound output time S based on the position in the music score.

Next, prediction of a sound output time using a dynamic model is described, from among techniques for prediction of a sound output time according to related arts.

The dynamic model generally updates, by the following exemplary process, a state vector V that indicates a state of a dynamic system to be predicted by the dynamic model.

More specifically, the dynamic model first predicts an after-change state vector V from a before-change state vector V by use of a state transition model, which is a theoretical model that expresses changes in the dynamic system over time. Secondly, by use of an observation model, the dynamic model predicts an observation value from the value of the state vector V predicted by the state transition model, where the observation model is a theoretical model that expresses a relationship between the state vector V and the observation value. Thirdly, the dynamic model calculates an observation residual based on the observation value predicted by the observation model and an actual observation value provided from outside the dynamic model. Fourthly, by correcting the value of the state vector V predicted by the state transition model using the observation residual, the dynamic model calculates an updated value of the state vector V. In this way, the dynamic model updates the state vector V.

In this embodiment, for example, it is assumed that the state vector V includes a performance position x and a speed v as its elements. Here, the performance position x is a state variable that represents an estimated value of a position in the music score that is being played by the player P or the automated musical instrument 30. The speed v is a state variable that represents an estimated value of a speed (tempo) of the performance of the player P or the automated musical instrument 30 in the music score. The state vector V may include state variables other than the performance position x and the speed v.

In this embodiment, for example, it is assumed that the state transition model is expressed by the following equation (2) and the observation model is expressed by the following equation (3).

$$V[n]=A_n V[n-1]+e[n] \tag{2}$$

$$u[n]=O_n V[n]+q[n] \tag{3}$$

Here, the state vector V[n] is a k-dimensional vector having as its elements multiple state variables including the performance position x[n] and the speed v[n] corresponding to a note that is the n-th to have been played (k is a natural number satisfying k≥2). The process noise e[n] is a k-dimensional vector that represents noise included in a state transition in the state transition model. The matrix $A_n$ is a matrix that shows coefficients related to updating of the state vector V in the state transition model. The matrix $O_n$ is a matrix that shows a relationship between the observation value (the sound output position u in this example) and the state vector V in the observation model. The subscript n appended to each of the elements such as matrices and variables indicates that the subject element corresponds to the n-th note.

Equations (2) and (3) can be made more specific as in the following equations (4) and (5), for example.

$$\begin{pmatrix} x[n] \\ v[n] \end{pmatrix} = \begin{pmatrix} 1 & T[n]-T[n-1] \\ 0 & 1 \end{pmatrix} \begin{pmatrix} x[n-1] \\ v[n-1] \end{pmatrix} + e[n] \tag{4}$$

$$u[n] = x[n] + q[n] \tag{5}$$

After the performance position x[n] and the speed v[n] are obtained from equations (4) and (5), the performance position x[t] at a future time t can be obtained by the following equation (6).

$$x[t]=x[n]+v[n](t-T[n]) \tag{6}$$

By applying the result of calculation by equation (6) to the following equation (7), it is possible to calculate the sound output time S[n+1] at which the automated musical instrument 30 is to output sound corresponding to the (n+1)th note.

$$S[n+1] = T[n] + \frac{x[n+1]-x[n]}{v[n]} \tag{7}$$

By using the dynamic model an advantage is obtained in that it is possible to predict a sound output time S in accordance with a position in the music score. Furthermore, by using the dynamic model, an advantage is obtained in that, essentially, there is no need to tune parameters (to perform learning) in advance.

In the ensemble system 1, a demand may arise whereby a degree of synchronization between the performance of the player P and the performance of the automated musical instrument 30 be made adjustable. In other words, in the ensemble system 1, a demand may arise whereby how closely the performance of the automated musical instrument 30 follows the performance of the player P be made adjustable.

However, to meet such a demand with the regression model according to related arts, in an exemplary case where a degree of synchronization between the performance of the player P and the performance of the automated musical instrument 30 is variously modified, it is necessary to perform learning in advance for each of various potential degrees by which synchronization may be modified. In this case, a problem exists in that a processing load accompanying in-advance learning increases.

Furthermore, in order to meet such a demand with the dynamic model according to related arts, a degree of synchronization is adjusted by use of variables such as a process noise e[n]. In this case, since the sound output time S[n+1] is calculated based on observation values related to output of sound by the player P, such as a sound output time T[n], it may be difficult to flexibly adjust a degree of synchronization.

While still based on the dynamic model according to related arts, the predictor 13 according to the present embodiment predicts the sound output time S[n+1] by a configuration in which how closely the performance of the automated musical instrument 30 follows the performance of the player P can be adjusted more flexibly as compared to the related arts. In the following description, exemplary processing performed by the predictor 13 of the present embodiment will be described.

The predictor 13 in this embodiment updates a state vector (referred to as "state vector Vu") representative of a state of a dynamic system that is related to the performance of the player P, and a state vector (referred to as "state vector Va") representative of a state of a dynamic system that is related to the performance of the automated musical instrument 30. Here, the state vector Vu is a vector that includes as its elements: a performance position xu that is a state variable for representing an estimated position in the music score that is currently being played by the player P; and a speed vu that is a state variable for representing an estimated value of a speed in the music score at which the player P is playing. The state vector Va is a variable that includes as its elements: a performance position xa that is a state variable for representing an estimated value of a position in the music score that is currently being played by the automated musical instrument 30; and a speed va that is a state variable for representing an estimated value of a speed in the music score at which the automated musical instrument 30 is playing. In the following description, the state variables (the performance position xu and the speed vu) included in the state vector Vu are referred to in general as "first state variables", while the state variables (the performance position xa and the speed va) included in the state vector Va are referred to in general as "second state variables".

In this embodiment, the predictor 13 updates the first state variables and the second state variables using a state transition model as shown, for example, in the following equations (8) to (11). In the state transition model, the first state variables are updated by equations (8) and (11). Equations (8) and (11) are equations produced by making equation (4) more specific. In the state transition model, the second state variables are updated by equations (9) and (10) below, instead of by equation (4) described above.

$$xu[n]=xu[n-1]+(T[n]-T[n-1])vu[n-1]+exu[n] \quad (8)$$

$$xa[n]=\gamma[n]\{xa[n-1]+(T[n]-T[n-1])va[n-1]+exa[n]\}+(1-\gamma[n])\{xu[n-1]+(T[n]-T[n-1])vu[n-1]+exu[n]\} \quad (9)$$

$$va[n]=va[n-1]+eva[n] \quad (10)$$

$$vu[n]=vu[n-1]+evu[n] \quad (11)$$

The process noise exu[n] is representative of noise that is generated when the performance position xu[n] is updated by the state transition model. The process noise exa[n] is representative of noise that is generated when the performance position xa[n] is updated by the state transition model. The process noise eva[n] is representative of noise that is generated when the speed va[n] is updated by the state transition model. The process noise evu[n] is representative of noise that is generated when the speed vu[n] is updated by the state transition model. The coupling coefficient γ[n] is a real number that satisfies $0 \leq \gamma[n] \leq 1$. In equation (9), the value "1−γ[n]" by which the performance position xu, which is a first state variable, is multiplied is an example of a "tracking coefficient".

As shown in equations (8) and (11), the predictor 13 according to this embodiment predicts the performance position xu[n] and the speed vu[n], which are first state variables, using the performance position xu[n−1] and the speed vu[n−1], which are first state variables. As shown in equations (9) and (10), the predictor 13 according to this embodiment predicts the performance position xa[n] and the speed va[n], which are second state variables, using: the performance position xu[n−1] and the speed vu[n−1], which are first state variables; or the performance position xa[n−1] and the speed va[n−1], which are second state variables; or the performance position xu[n−1], the speed vu[n−1], the performance position xa[n−1], and the speed va[n−1].

In updating the performance position xu[n] and the speed vu[n], which are first state variables, the predictor 13 according to this embodiment uses the state transition model shown in equations (8) and (11) and the observation model shown in equation (5). In updating the performance position xa[n] and the speed va[n], which are second state variables, the predictor 13 according to this embodiment uses the state transition model shown in equations (9) and (10) and does not use the observation model.

As shown in equation (9), the predictor 13 according to this embodiment predicts the performance position xa[n], which is a second state variable, based on a product resulting from multiplying a first state variable (e.g., performance position xu[n−1]) by the tracking coefficient (1−γ[n]), and based on a product resulting from multiplying a second state variable (e.g., performance position xa[n−1]) by the coupling coefficient γ[n]. In this way, by adjusting the value of the coupling coefficient γ[n], the predictor 13 of this embodiment can adjust how closely the performance of the automated musical instrument 30 follows the performance of the player P. In other words, by adjusting the value of the coupling coefficient γ[n], the predictor 13 of this embodiment can adjust the degree of synchronization between the performance of the automated musical instrument 30 and the performance of the player P. In a case where a large value is set to the tracking coefficient (1−γ[n]), as compared to a case where a small value is set to the tracking coefficient (1−γ[n]), a property of the performance of the automated musical instrument 30 to follow the performance of the player P can be strengthened. In other words, in a case where a large value is set to the coupling coefficient γ[n], as compared to a case where a small value is set to the coupling coefficient γ[n], a property of the performance of the automated musical instrument 30 to follow the performance of the player P can be weakened.

As described above, according to this embodiment, by changing a single coefficient, namely the coupling coefficient γ, it is possible to adjust the degree of synchronization between the performance of the player P and the performance of the automated musical instrument 30. In other words, according to this embodiment, it is possible to adjust a mode of outputting sound (an example of "operation mode of a second event") by the automated musical instrument 30 in music performance based on the tracking coefficient (1−γ[n]).

The predictor 13 includes a receiver 131, a coefficient determiner 132, a state variable updater 133, and a predicted time calculator 134.

The receiver 131 receives input of observation values related to timings of music performance. In this embodiment, the observation values related to timings of music performance include first observation values related to timings of music performance of the player P. In addition to first observation values, the observation values related to timings of music performance may include second observation values related to timings of music performance of the automated musical instrument 30. Here, first observation values are a generic term for a sound output time T and a sound output position u (hereafter referred to as "sound output position uu") related to the performance of the player P. Second observation values are a generic term for a sound output time S and a sound output position u (hereafter referred to as "sound output position ua") related to the performance of the automated musical instrument 30. In addition to input of observation values related to timings of music performance, the receiver 131 receives input of observation values accompanying the observation values related to timings of music performance. In this embodiment, the accompanying observation values represent observation noise q related to the performance of the player P. The receiver 131 stores the received observation values in the storage medium 11.

The coefficient determiner 132 determines the value of the coupling coefficient γ. The value of the coupling coefficient γ is set in advance in accordance with a position that is in the music score and is being played, for example. The storage medium 11 of this embodiment stores profile information in which a position that is being played in the music score and a value of the coupling coefficient γ corresponding to the position are associated to each other. The coefficient determiner 132 refers to the profile information stored in the storage medium 11 and retrieves the value of the coupling coefficient γ corresponding to the position that is being played in the music score. The coefficient determiner 132 then sets the value retrieved from the profile information as the value of the coupling coefficient γ.

Alternatively, the coefficient determiner 132 may determine the value of the coupling coefficient γ to be a value corresponding to an instruction by an operator (an example of "user") of the controller 10, for example. In this case, the controller 10 includes a UI (User Interface) for receiving operations that indicate instructions from the operator. The UI may be software UI (UI through a screen displayed by software) or hardware UI (e.g., a fader). Generally, the operator and the player P are different persons; however, the player P may act as the operator.

The state variable updater 133 updates state variables (first state variables and second state variables). Specifically, the state variable updater 133 according to this embodiment updates state variables using above mentioned equation (5) and equations (8) to (11). More specifically, the state variable updater 133 according to this embodiment updates first state variables using equations (5), (8), and (11), and updates second state variables using equations (9) and (10). The state variable updater 133 then outputs the updated state variables.

As is clear from the above description, the state variable updater 133 updates second state variables based on the coupling coefficient γ that has a value determined by the coefficient determiner 132. In other words, the state variable updater 133 updates second state variables based on the tracking coefficient (1−γ[n]). In this way, the controller 10 according to this embodiment adjusts a mode of outputting sound by the automated musical instrument 30 in music performance based on the tracking coefficient (1−γ[n]).

Using the updated state variables, the predicted time calculator 134 calculates the sound output time S[n+1], which is a time at which sound is output next by the automated musical instrument 30.

Specifically, the predicted time calculator 134 calculates the performance position x[n] at a future time t by applying the state variables updated by the state variable updater 133 to equation (6). More specifically, the predicted time calculator 134 calculates the performance position x[n+1] at the future time t by applying to equation (6) the performance position xa[n] and the speed va[n], both of which have been updated by the state variable updater 133. Next, using equation (7), the predicted time calculator 134 calculates the sound output time S[n+1] at which the automated musical instrument 30 is to output sound corresponding to the (n+1)th note.

Alternatively, the predicted time calculator 134 may calculate the performance position x[n] at the future time t by applying to equation (6) the performance position xu[n] and the speed vu[n], which have been updated by the state variable updater 133.

The outputter 14 outputs toward the automated musical instrument 30 a performance instruction corresponding to a note whose sound is to be output by the automated musical instrument 30 next, in accordance with the sound output time S[n+1] input from the predictor 13. The controller 10 includes an internal clock (illustration omitted) and measures the time. The performance instruction is written according to a predetermined data format. An example of the predetermined data format is MIDI. The performance instruction includes, for example, a note-on message, a note number, and a velocity.

The display 15 displays information related to a result of the estimation of a performance position and information related to a result of the prediction of time at which a subsequent sound is output by the automated musical instrument 30. The information related to the estimation of a performance position includes, for example, at least one of the music score, a frequency spectrogram of the input sound signal, or a probability distribution of the estimated value of the performance position. The information related to the result of the prediction of time at which a subsequent sound is output includes, for example, state variables. From the display 15 displaying the information related to the result of the estimation of the performance position and the information related to the result of the prediction of the sound output time, the operator (user) of the controller 10 is able to understand operating statuses of the ensemble system 1.

Figure 3:
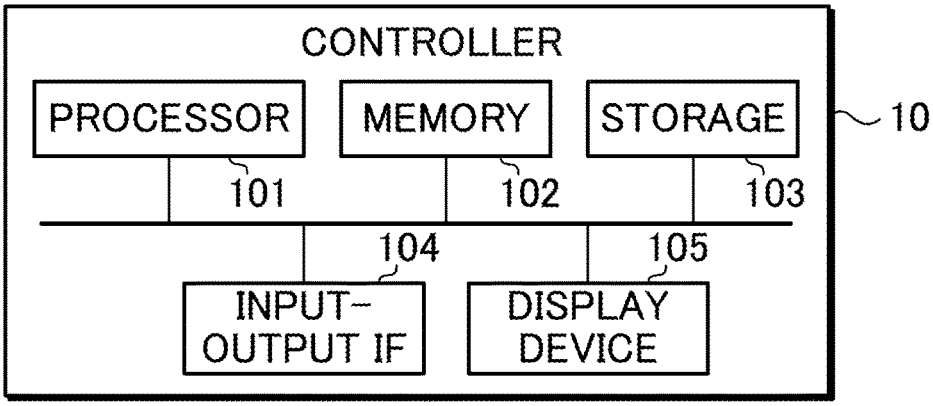
FIG. 3 is a block diagram of the controller 10.

FIG. 3 is a diagram showing an exemplary hardware configuration of the controller 10. The controller 10 is a computer device that includes a processor 101, a memory 102, a storage 103, an input-output IF 104, and a display device 105.

The processor 101 is a CPU (central processing unit), for example, and controls each element of the controller 10. Alternatively, the processor 101 may be configured to include a programmable logic device, such as a DSP (digital signal processor) or an FPGA (field programmable gate array), instead of or in addition to the CPU. The processor 101 may include multiple CPUs (or multiple programmable logic devices). The memory 102 is a non-transient recording medium and is a volatile memory, such as a RAM (random access memory). The memory 102 serves as a work area when the processor 101 executes a control program described later. The storage 103 is a non-transient recording medium and is a non-volatile memory, such as an EEPROM (electrically erasable programmable read-only memory). The storage 103 stores various programs, such as the control program for controlling the controller 10, and various data. The input-output IF 104 is an interface for receiving input signals from or outputting signals to other devices. Functions carried out by the input-output IF 104 include microphone input and MIDI output, for example. The display device 105 is a device that outputs various information, and includes an LCD (liquid crystal display), for example.

The processor 101 serves as the estimator 12, the predictor 13, and the outputter 14 by executing the control program stored in the storage 103 and operating in accordance with the control program. Either one or both of the memory 102 and the storage 103 provide functions as the storage medium 11. The display device 105 provides functions as the display 15.

2. Operations

Figure 4:
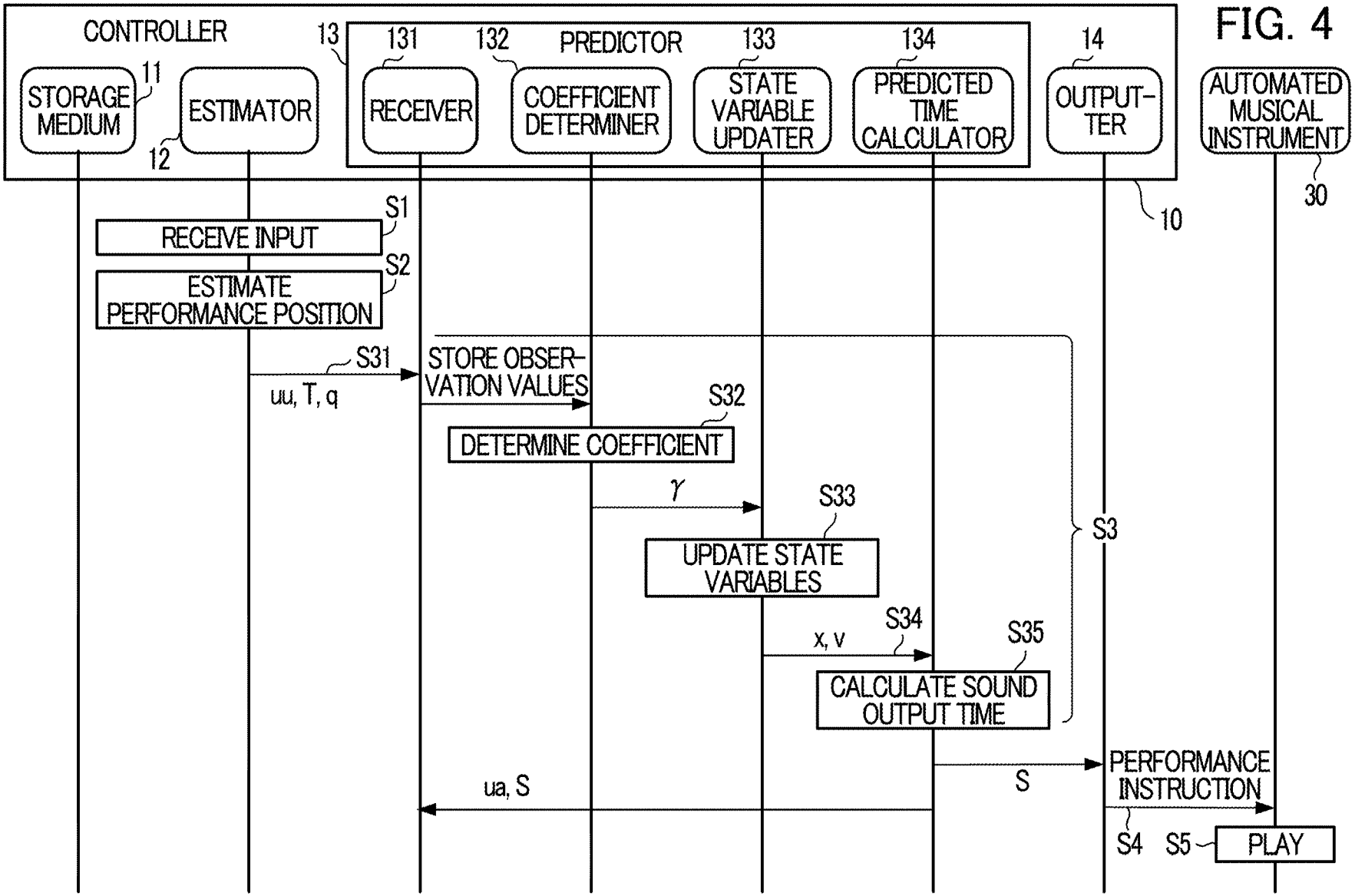
FIG. 4 is a sequence diagram of the controller 10.

FIG. 4 is a sequence diagram showing exemplary operations of the controller 10. The sequence diagram shown in FIG. 4 is initiated, for example, upon the control program being activated by the processor 101.

At step S1, the estimator 12 receives input of a sound signal. In a case where the sound signal is an analog signal, the sound signal is converted into a digital signal by a DA convertor (illustration omitted) provided in the controller 10, for example, and the sound signal that has been converted into the digital signal is input to the estimator 12.

At step S2, the estimator 12 analyzes the sound signal to estimate a position that is currently played in the music score. Processing related to step S2 is executed, for example, as follows. In this embodiment, the transition of the performance position in the music score (music-score time series) is described using a probability model. By using the probability model in describing the music-score time series, it is possible to address problems, such as errors in the performance, omission of repetition in the performance, fluctuations in tempo during the performance, or uncertainties in pitches or sound output times during the performance. As a probability model describing the music-score time series, the Hidden Semi-Markov Model (HSMM) may be used, for example. The estimator 12 obtains a frequency spectrogram by dividing the sound signal into frames and performing the constant-Q transform on the frames, for example. The estimator 12 extracts onset times and pitches from the frequency spectrogram. The estimator 12 sequentially estimates, with a delayed-decision technique, distributions of a probabilistic estimated value indicating the position currently being played in the music score, and when the peak of each distribution passes a location that is considered as an onset in the music score, the estimator 12 outputs a Laplace approximation of the distribution and outputs one or more statistics. More specifically, after detecting that sound corresponding to the n-th note in the music data has been output, the estimator 12 outputs: the sound output time T[n] at which output of the sound is detected; and the mean and variance of the position in the music score in the distribution indicating probabilistic positions of the output sound in the music score. The mean position in the music score is an estimated value of the sound output position u[n], and the variance is an estimated value of the observation noise q[n]. Details of sound output position estimation is described in Japanese Patent Application Laid-Open Publication No. 2015-79183, for example.

Figure 5:
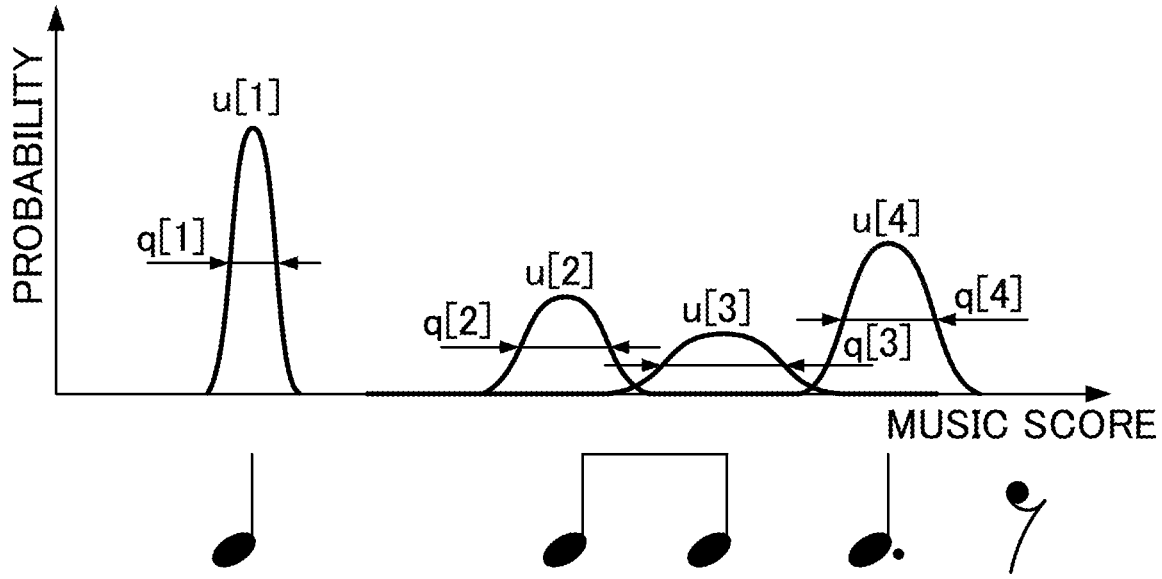
FIG. 5 is an explanatory diagram illustrating sound output positions u[n] and observation noises q[n].

FIG. 5 is an explanatory diagram showing exemplary sound output positions u[n] and observation noises q[n]. In the example shown in FIG. 5, a case is shown in which there are four notes per bar in the music score. The estimator 12 calculates probability distributions P[1] to P[4] that correspond one-to-one with four sound outputs corresponding to the four notes included in the bar. The estimator 12 then outputs the sound output times T[n], the sound output positions u[n], and the observation noises q[n] based on the result of the calculation.

FIG. 4 is referred to again. In step S3, the predictor 13 performs prediction of a time at which a subsequent sound is output by the automated musical instrument 30 using the estimated values provided by the estimator 12 as the observation values. In the following, exemplary details of processing in step S3 are described.

In step S3, the receiver 131 receives input of observation values (first observation values), such as the sound output position uu, the sound output time T, and the observation noise q, provided by the estimator 12 (step S31). The receiver 131 stores these observation values in the storage medium 11.

In step S3, the coefficient determiner 132 determines the value of the coupling coefficient γ used in updating the state variables (step S32). More specifically, referring to the profile information stored in the storage medium 11, the coefficient determiner 132 acquires the value of the coupling coefficient γ corresponding to the current performance position in the music score, and sets the acquired value to the coupling coefficient γ. In this way, it is possible to adjust, in accordance with the position currently being played in the music score, a degree of synchronization between the performance of the player P and the performance of the automated musical instrument 30. In other words, the controller 10 in the present embodiment enables the automated musical instrument 30 to execute, in some parts of the music piece, an automated performance that follows the performance of the player P, and in other parts of the music piece, an automated performance that is independent of the performance of the player P. Thus, by use of the controller 10 of the present embodiment, a performance by the automated musical instrument 30 can be made to sound less mechanical (can be made to sound relatively natural). For example, in a case where the tempo of the performance of the player P is definite, the controller 10 of this embodiment may cause the automated musical instrument 30 to execute an automated performance at a tempo that follows the tempo of the performance of the player P more closely than the tempo of the performance predetermined by the music data. Furthermore, in a case where, for example, the tempo of the performance of the player P is not definite, the controller 10 of this embodiment may cause the automated musical instrument 30 to execute an automated performance at a tempo that follows the tempo of the performance predetermined by the music data more closely than the tempo of the performance of the player P.

In step S3, the state variable updater 133 updates the state variables using the observation values input thereto (step S33). As described above, in step S33, the state variable updater 133 updates first state variables by use of equations (5), (8), and (11), and updates second state variables using equations (9) and (10). Additionally, in step S33, the state variable updater 133 updates the second state variables based on the tracking coefficient (1−γ[n]) as shown in equation (9).

In step S3, the state variable updater 133 outputs the state variables updated in step S33 toward the predicted time calculator 134 (step S34). More specifically, in step S34, the state variable updater 133 of this embodiment outputs the performance position xa[n] and the speed va[n] updated in step S33 to the predicted time calculator 134.

In step S3, the predicted time calculator 134 applies the state variables input from the state variable updater 133 to equations (6) and (7), and calculates the sound output time S[n+1] at which sound of the (n+1)th note is to be output (step S35). More specifically, in step S35, the predicted time calculator 134 calculates the sound output time S[n+1] based on the performance position xa[n] and the speed va[n] input from the state variable updater 133. The predicted time calculator 134 then outputs the sound output time S[n+1] obtained by the calculation to the outputter 14.

Upon arrival of the sound output time S[n+1] input by the predictor 13, the outputter 14 outputs to the automated musical instrument 30 a performance instruction corresponding to the (n+1)th note whose sound is to be output next by the automated musical instrument 30 (step S4). In reality, the performance instruction needs to be output earlier than the sound output time S[n+1] predicted by the predictor 13 due to a delay in the processing by the outputter 14 and the automated musical instrument 30, but description thereof will be omitted here. The automated musical instrument 30 outputs sound in accordance with the performance instruction provided by the controller 10 (step S5).

At predetermined timings, the predictor 13 determines whether performance has ended. More specifically, the predictor 13 determines completion of performance based on the performance position estimated by the estimator 12, for example. In a case where the performance position has reached a predetermined end point, the predictor 13 determines that the performance has ended. In a case where the predictor 13 determines that the performance has ended, the controller 10 ends the processing shown in the sequence diagram in FIG. 4. In a case where the predictor 13 determines that the performance has not ended, the controller 10 and the automated musical instrument 30 repeatedly execute the processing in steps S1 to S5.

Figure 7:
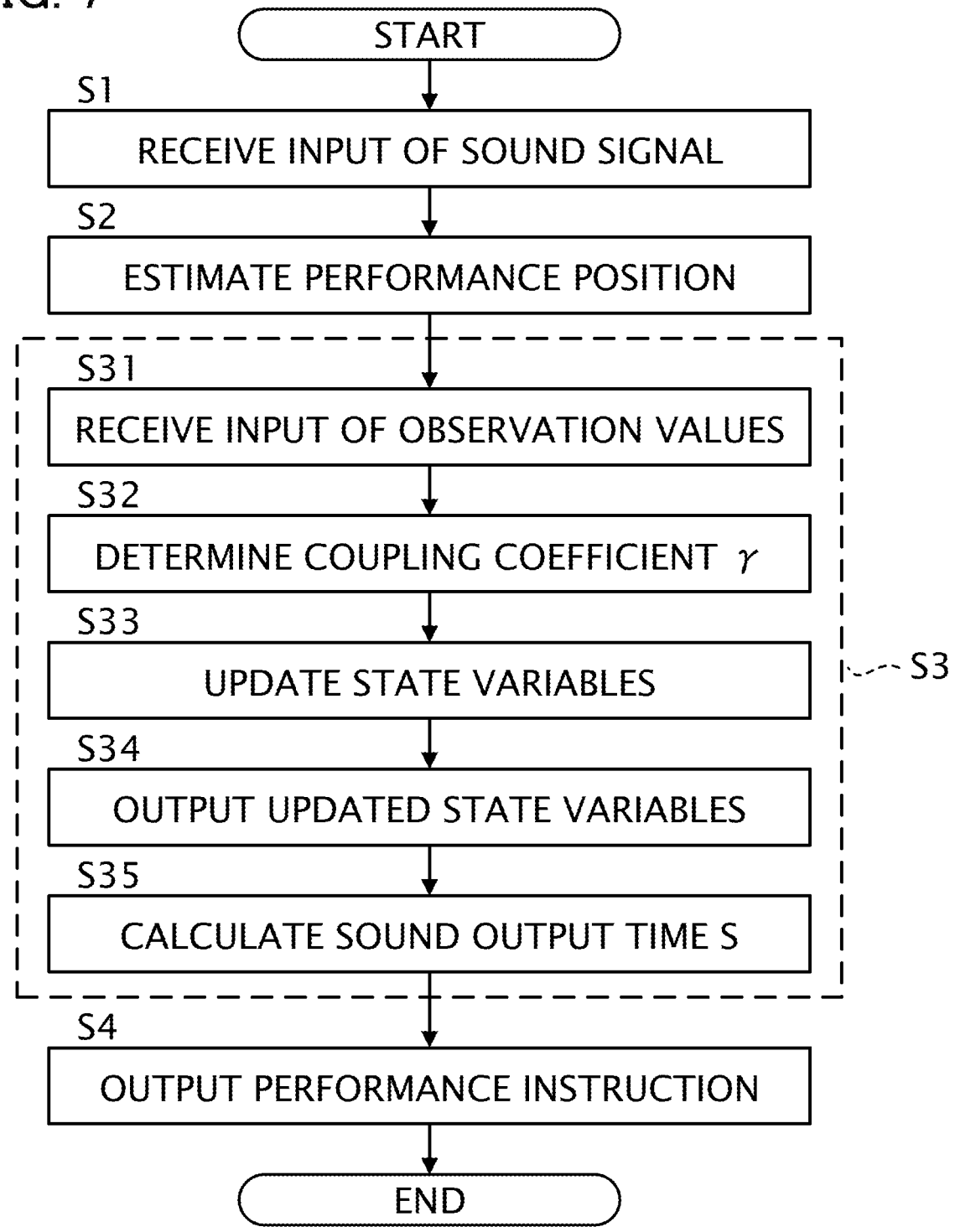
FIG. 7 is a flowchart of the controller 10.

Operations of the controller 10 shown in the sequence diagram in FIG. 4 can also be expressed in the same manner as in the flowchart in FIG. 7. In step S1, the estimator 12 receives input of a sound signal. In step S2, the estimator 12 estimates the position currently being played in the music score. In step S31, the receiver 131 receives input of observation values provided by the estimator 12. In step S32, the coefficient determiner 132 determines the coupling coefficient γ[n]. In step S33, the state variable updater 133 updates each state variable in the state vector V using the observation values received by the receiver 131 and the coupling coefficient γ[n] determined by the coefficient determiner 132. In step S34, the state variable updater 133 outputs the state variables updated in step S33 to the predicted time calculator 134. In step S35, the predicted time calculator 134 calculates the sound output time S[n+1] using the updated state variables output from the state variable updater 133. In step S4, the outputter 14 outputs the performance instruction to the automated musical instrument 30 based on the sound output time S[n+1].

3. Modifications

The present disclosure is not limited to the above embodiment, and various modifications may be made. Some exemplary modifications are described below. Two or more of the following modifications may be combined and used.

3-1. Modification 1

The device (hereafter referred to as "device to be controlled") for which the timing is controlled by the controller 10 is not limited to the automated musical instrument 30. In other words, the "event" for which the predictor 13 predicts a timing is not limited to output of sound by the automated musical instrument 30. The device to be controlled may be, for example, a device that generates an image that changes with the performance of the player P synchronously (e.g., a device that generates computer graphics that change in a real-time manner), or a display device that causes images to change in synchronization with the performance of the player P (e.g., a projector or a direct-view-type display). In another example, the device to be controlled may be a robot that makes movements, such as dancing, in synchronization with the performance of the player P.

3-2. Modification 2

The player P need not be a human being. In other words, performance sound by another automated musical instrument different from the automated musical instrument 30 may be input to the controller 10. In this example, in a performance in which multiple automated musical instruments play together, it is possible to cause the timing of performance of one automated musical instrument to follow the performance timing of the other automated musical instrument in real-time.

3-3. Modification 3

The number of players P and the number of automated musical instruments 30 are not limited to the examples shown in the embodiment. The ensemble system 1 may include: two or more players P; two or more automated musical instruments 30; or two or more players P and two or more automated musical instruments 30.

3-4. Modification 4

The functional configuration of the controller 10 is not limited to the example shown in the embodiment. A part of the functional elements shown as examples in FIG. 2 may be omitted. For example, the controller 10 is not required to include the predicted time calculator 134. In this case, the controller 10 may simply output state variables updated by the state variable updater 133. In such a case, a device to which the state variables updated by the state variable updater 133 are input, the device being other than the controller 10, may calculate the timing of the subsequent event (e.g., the sound output time S[n+1]). Furthermore, in such a case, a device other than the controller 10 may perform processing (e.g., display of images that visualize the state variables) other than the calculation of the timing of the subsequent event. In another example, the controller 10 may not include the display 15.

3-5. Modification 5

In the embodiment and modifications described above, the coefficient determiner 132 determines the coupling coefficient γ to have a value corresponding to the position currently being played in the music score. In an embodiment, the coefficient determiner 132 may determine the value of the coupling coefficient γ to be a predetermined default value, a value corresponding to a result of analyzing the music score, or a value corresponding to an instruction from the user.

Figure 6:
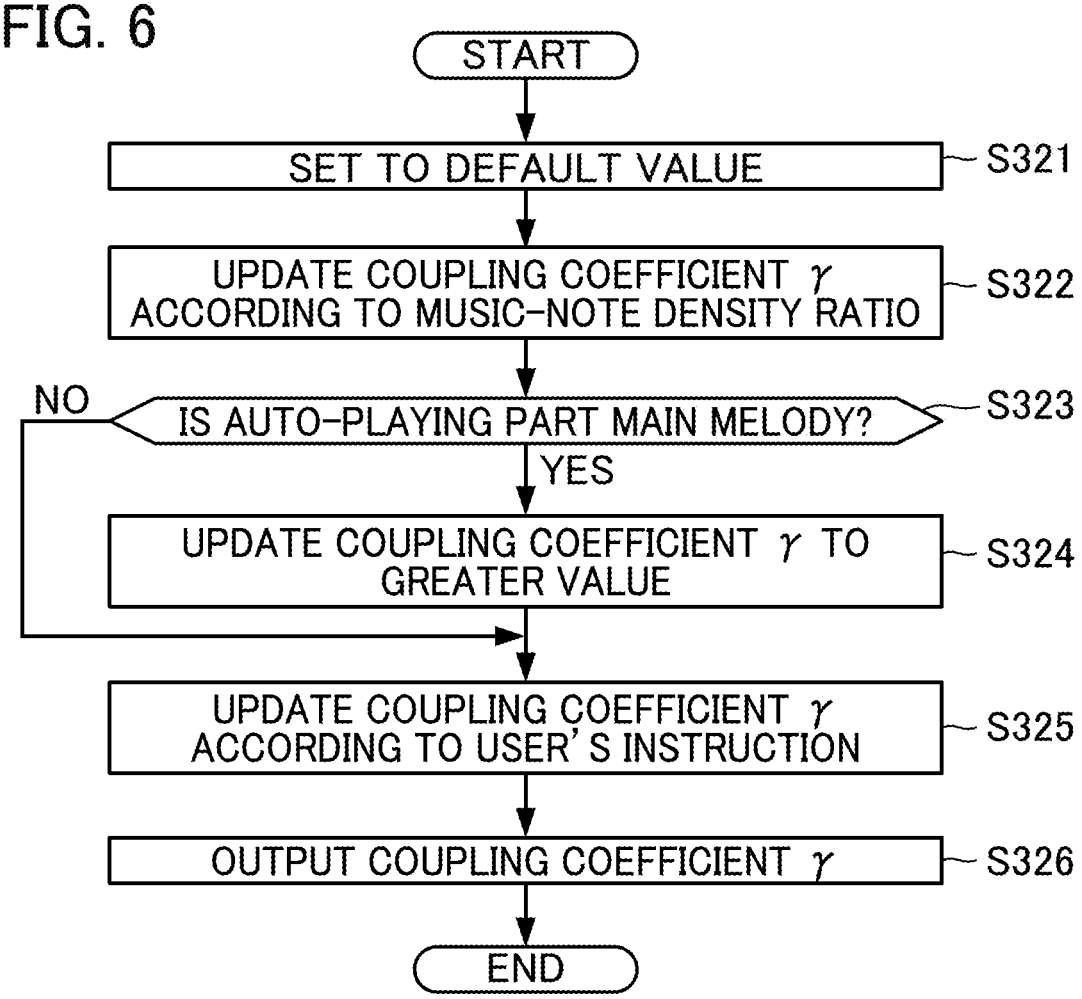
FIG. 6 is a flowchart for determining a coupling coefficient γ according to Modification 5 or more embodiments.

FIG. 6 is a flowchart that shows an exemplary method of determination of the coupling coefficient γ by the coefficient determiner 132 according to Modification 5 or more embodiments. Each process in the flowchart is a process executed during the process in step S32 shown in FIG. 4.

As shown in FIG. 6, in step S32, the coefficient determiner 132 sets the value of the coupling coefficient γ[n] to a default value (step S321).

In this modification, the storage medium 11 stores the default value of the coupling coefficient γ[n], wherein the default value does not depend on the music piece (or position that is currently being played in the music score). In step S321, the coefficient determiner 132 retrieves the default value of the coupling coefficient γ[n] stored in the storage medium 11, and sets the retrieved default value as the value of the coupling coefficient γ[n].

In step S32, the coefficient determiner 132 analyzes the music score, and sets a value that is in accordance with the result of the analysis as the value of the coupling coefficient γ[n] (step S322).

More specifically, in step S322, by analyzing the music score, the coefficient determiner 132 first calculates a ratio (hereafter referred to as "music-note density ratio") of a density of notes indicating sound output by the player P to a density of notes indicating sound output by the automated musical instrument 30. Next, the coefficient determiner 132 sets a value corresponding to the calculated music-note density ratio as the value of the coupling coefficient γ[n]. In other words, the coefficient determiner 132 determines the tracking coefficient (1−γ[n]) based on the music-note density ratio.

For example, the coefficient determiner 132 sets the value of the coupling coefficient γ[n] such that the value of the coupling coefficient γ[n] is smaller in a case where the music-note density ratio is greater than a predetermined threshold value, than in a case where the music-note density ratio is equal to or smaller than the predetermined threshold value. In other words, the coefficient determiner 132 sets the value of the coupling coefficient γ[n] such that in a case where the music-note density ratio is greater than the predetermined threshold value, the value of the tracking coefficient (1−γ[n]) is greater compared to a case where the music-note density ratio is equal to or smaller than the predetermined threshold value. That is, the coefficient determiner 132 sets the value of the coupling coefficient γ[n] such that in a case where the music-note density ratio is greater than the predetermined threshold value, the performance of the automated musical instrument 30 follows the performance of the player P more closely as compared to a case where the music-note density ratio is equal to or smaller than the predetermined threshold value.

In one example, the coefficient determiner 132 may set the value of the coupling coefficient γ[n] based on a density $DA_n$ of notes indicating sound output by the automated musical instrument 30 and a density $DU_n$ of notes indicating sound output by the player P, as shown in the following equation (12). Alternatively, in equation (12), $DA_n$ may indicate a density of sound output by the automated musical instrument 30 and $DU_n$ may indicate a density of sound output by the player P.

$$\gamma[n] = \frac{DA_n}{DA_n + DU_n} \tag{12}$$

In step S32, the coefficient determiner 132 analyzes the music score, and determines whether the part played by the automated musical instrument 30 is a main melody part (step S323). A publicly known technique is used to determine whether the part played by the automated musical instrument 30 is a main melody part or not.

In a case where it is determined that the part played by the automated musical instrument 30 is the main melody part (S323: YES), the coefficient determiner 132 advances the processing to step S324. In a case where it is determined that the part played by the automated musical instrument 30 is not the main melody part (S323: NO), the coefficient determiner 132 advances the processing to step S325.

In step S32, the coefficient determiner 132 updates the value of the coupling coefficient γ[n] to a greater value (step S324).

For example, in step S324, the coefficient determiner 132 updates the value of the coupling coefficient γ[n] to a value that is greater than the value indicated in the right-hand side of equation (12). For example, the coefficient determiner 132 may calculate the updated coupling coefficient γ[n] by adding a predetermined non-negative addition value to the value indicated in the right-hand side of equation (12). Alternatively, for example, the coefficient determiner 132 may calculate the updated coupling coefficient γ[n] by multiplying the value indicated in the right-hand side of equation (12) by a predetermined coefficient greater than one. The coefficient determiner 132 may determine the updated coupling coefficient γ[n] to be a value equal to or smaller than a predetermined upper limit.

In step S32, the coefficient determiner 132 updates the value of the coupling coefficient γ[n] according to an instruction from the user at a rehearsal, etc. (step S325).

In this modification, the storage medium 11 stores instruction information that indicates content of instructions from the user at a rehearsal, etc. The instruction information includes information that identifies a lead part in the performance. The information identifying the lead part in the performance is, for example, information identifying whether the lead part in the performance is a part played by the player P or a part played by the automated musical instrument 30. The information identifying a lead part in the performance may be set in accordance with the position that is currently being played in the music score. In a case where there are no instructions from the user at a rehearsal, or the like, the instruction information may be information indicating that there are no instructions from the user.

In step S325, in a case where the instruction information is information indicating that the player P holds a lead position, the coefficient determiner 132 updates the value of the coupling coefficient γ[n] to a smaller value. In a case where the instruction information is information indicating that the automated musical instrument 30 holds a lead position, the coefficient determiner 132 updates the value of the coupling coefficient γ[n] to a greater value. In a case where the instruction information is information indicating that there are no instructions from the user, the coefficient determiner 132 does not update the value of the coupling coefficient γ[n].

As described above, in the example shown in FIG. 6, it is assumed that there are three types of content, for the user's instructions, that can be indicated by the instruction information: content indicating that the player P is to hold a lead position; content indicating that the automated musical instrument 30 is to hold a lead position, and content indicating that there are no instructions from the user. However, the instruction information is not limited to these examples. There may be more than three types of user instruction content that can be indicated by the instruction information. For example, content of the user's instructions indicated by the instruction information may be information that can indicate levels (e.g., high, middle, and low) indicating the strength of the lead position, and may specify one of the levels.

In step S32, the coefficient determiner 132 outputs the value of the coupling coefficient γ[n] determined through the processing in steps S321 to S325 to the state variable updater 133 (step S326).

In the example shown in FIG. 6, there are shown four exemplary decision factors for determining the coupling coefficient γ[n]: "the user's instruction (result of a rehearsal)"; "the part corresponding to a main melody"; "music-note density ratio"; and "default value". In the example shown in FIG. 6, an exemplary case is described in which the order of priority for these four decision factors in determination of the coupling coefficient γ[n] is: "the user's instruction">"the part corresponding to a main melody">"music-note density ratio">"default value".

However, the present disclosure is not limited to such a form. The coefficient determiner 132 may use only a part of the four decision factors described above when determining the coupling coefficient γ[n]. In other words, the processing by which the coefficient determiner 132 determines the coupling coefficient γ[n] may include, from among processes of steps S321 to S326 shown in FIG. 6: at least one of the process of step S321, the process of step S322, the processes of steps S323 and S324, or the process of step S325; and the process of step S326.

The order of priority for the decision factors in determination of the coupling coefficient γ[n] is not limited to the example shown in FIG. 6, and may be freely chosen. For example, "the part corresponding to a main melody" may have a higher priority than "the user's instruction"; "music-note density ratio" may have a higher priority than "the user's instruction"; or "music-note density ratio" may have a higher priority than "the part corresponding to a main melody". In other words, the processes of steps S321 to S326 shown in FIG. 6 may be rearranged as appropriate in a different order 3-6. Modification 6

In the dynamic model according to the embodiment described above, state variables are updated using observation values (the sound output position u[n] and the observation noise q[n]) at a single time point. However, the present disclosure is not limited to such a form, and state variables may be updated using observation values at multiple time points. More specifically, in the observation model used in the dynamic model, the following equation (13) may be used instead of equation (5).

$$\begin{pmatrix} u[n-1] \\ u[n-2] \\ \vdots \\ u[n-j] \end{pmatrix} = O_n \begin{pmatrix} x[n] \\ v[n] \end{pmatrix} + \begin{pmatrix} q[n-1] \\ q[n-2] \\ \vdots \\ q[n-j] \end{pmatrix} \tag{13}$$

The matrix $O_n$ is a matrix that shows relationships between observation values (sound output positions u[n−1], u[n−2], . . . , u[n−j] in this example), the performance position x[n], and the speed v[n], in the observation model. As in this modification, by updating state variables using observation values at multiple time points, it is possible to reduce effects of unexpected noise arising in the observation values, the effects being on the prediction of the sound output time S[n+1], as compared to a case where state variables are updated using observation values at a single time point.

3-7. Modification 7

In the embodiment and modifications described above, state variables are updated using first observation values. However, the present disclosure is not limited to such a form, and the state variables may be updated using both first observation values and second observation values.

For example, in updating the performance position xa[n] with the state transition model, the following equation (14) may be used instead of equation (9). In equation (9), only the sound output time T, which is a first observation value, is used as the observation value; whereas in equation (14), the sound output time T, which is a first observation value, and the sound output time S, which is a second observation value, are used as the observation values.

$$xa[n]=\gamma[n]\{xa[n-1]+(S[n]-S[n-1])va[n-1]+exa[n]\}+(1-\gamma[n])\{xu[n-1]+(T[n]-T[n-1])vu[n-1]+exu[n]\} \quad (14)$$

In updating the performance position xu[n] and the performance position xa[n] with the state transition model, the following equation (15) may be used instead of equation (8), and the following equation (16) may be used instead of equation (9). The sound output time Z appearing in equations (15) and (16) is a generic term for the sound output time S and the sound output time T.

$$xu[n]=xu[n-1]+(Z[n]-Z[n-1])vu[n-1]+exu[n] \quad (15)$$

$$xa[n]=\gamma[n]\{xa[n-1]+(Z[n]-Z[n-1])va[n-1]+exa[n]\}+(1-\gamma[n])\{xu[n-1]+(Z[n]-Z[n-1])vu[n-1]+exu[n]\} \quad (16)$$

In a case where both first observation values and second observation values are used in the state transition model as in the present modification, both first observation values and second observation values may be used in the observation model also. More specifically, in the observation model, state variables may be updated using equation (17), which is derived by making equation (5) of the embodiment more specific, and equation (18) below.

$$uu[n]=xu[n]+q[n] \quad (17)$$

$$ua[n]=xa[n]+q[n] \quad (18)$$

In a case where both first observation values and second observation values are used to update state variables as in this modification, the state variable updater 133 may receive from the receiver 131 the first observation values (the sound output position uu and the sound output time T), and may receive from the predicted time calculator 134 the second observation values (the sound output position ua and the sound output time S).

3-8. Modification 8

In the embodiment and modifications described above, the controller 10 controls the time (timing) at which sound is output by the automated musical instrument 30. However, the present disclosure is not limited to such a form, and the controller 10 may control a volume of sound output by the automated musical instrument 30. That is, the form for sound outputting performed by the automated musical instrument 30, which form is controlled by the controller 10, may be the volume of sound output in the sound outputting performed by the automated musical instrument 30. In other words, by adjusting the value of the coupling coefficient γ, the controller 10 may adjust how closely the volume of sound output during the performance of the automated musical instrument 30 follows the volume of sound output during the performance of the player P.

Furthermore, the controller 10 may control both the time (timing) at which sound is output by the automated musical instrument 30 and the volume of sound output by the automated musical instrument 30.

3-9. Modification 9

In the embodiment and modifications described above, the predicted time calculator 134 calculates the performance position x[t] at a future time t using equation (6), but the present disclosure is not limited to such a form. For example, the state variable updater 133 may calculate the performance position x[n+1] using the dynamic model that updates state variables.

3-10. Modification 10

Behaviors of the player P detected by the group of sensors 20 are not limited to sound that is played. The group of sensors 20 may detect movements of the player P, in addition to or instead of the played sound. In this case, the group of sensors 20 includes a camera or a motion sensor.

3-11. Other Modifications

The algorithm for estimating the performance position in the estimator 12 is not limited to the example shown in the embodiment. Any algorithm may be applied so long as the algorithm enables the estimator 12 to estimate the position that is currently being played in the music score based on the music score that is given in advance and a sound signal input from the group of sensors 20. Furthermore, the observation values input to the predictor 13 from the estimator 12 are not limited to the examples shown in the embodiment. Any observation values other than the sound output position u and the sound output time T may be input to the predictor 13, so long as the observation values are related to the timing of the music performance.

The dynamic model used in the predictor 13 is not limited to the example shown in the embodiment. In the embodiment and modifications described above, the predictor 13 updates the state vector Va (a second state variable) without using the observation model. Alternatively, the predictor 13 may update the state vector Va using both the state transition model and the observation model.

In the embodiment and modifications described above, the predictor 13 updates the state vector Vu using the Kalman filter. Alternatively, the predictor 13 may update the state vector V using an algorithm other than the Kalman filter. For example, the predictor 13 may update the state vector V using a particle filter. In this case, the state transition model used in the particle filter may be equation (2), (4), (8), or (9) described above, or a state transition model different from these equations may be used. The observation model used in the particle filter may be equation (3), (5), (10), or (11), or an observation model different from these equations may be used.

In addition to or instead of the performance position x and the speed v, state variables other than these state variables may be used. Equations shown in the embodiment are intended for exemplary purposes only, and the present disclosure is not limited to these examples.

The hardware configuration of each device forming the ensemble system 1 is not limited to the example shown in the embodiment. Each device may have any specific hardware configuration so long as required functions can be realized. For example, instead of including a single processor 101 executing the control program to serve as the estimator 12, the predictor 13, and the outputter 14, the controller 10 may include multiple processors each corresponding to one of the estimator 12, the predictor 13, and the outputter 14. Alternatively, physically separate devices may cooperate with each other to serve as the controller 10 in the ensemble system 1.

The control program executed by the processor 101 in the controller 10 may be provided in a format stored in a non-transitory recording medium, such as an optical disk, a magnetic disc, or a semiconductor memory, or may be provided by being downloaded via a communication line, such as the Internet. The control program need not include all of the steps shown in FIG. 4. For example, this program may include steps S31, S33, and S34 alone.

Some aspects as understood from the description in the above embodiment and modifications are described below.

Aspect 1

A control method according to a first aspect includes: receiving a result of detection related to a first event in a music performance; determining a tracking coefficient that indicates how closely a second event follows the first event in the music performance; and determining an operation mode of the second event based on the tracking coefficient.

According to this aspect, it is possible to adjust how closely the second event follows the first event.

Aspect 2

A control method according to a second aspect includes: receiving a first observation value related to a first event in a music performance; updating a first state variable related to the first event by using the first observation value; and updating a second state variable related to a second event in the music performance by using a product resulting from multiplication of the updated first state variable by a tracking coefficient.

According to this aspect, it is possible to adjust how closely the second event follows the first event.

Aspect 3

A control method according to a third aspect is the control method according to the first aspect, wherein in determining the tracking coefficient, determining the tracking coefficient to be a value corresponding to a position that is being played in a piece of the music.

According to this aspect, it is possible to adjust how closely the second event follows the first event in accordance with a performance position in the piece of music.

Aspect 4

A control method according to a fourth aspect is the control method according to the first aspect, wherein in determining the tracking coefficient, determining the tracking coefficient to be a value corresponding to a ratio of a density of music notes involved in the first event to a density of music notes involved in the second event.

According to this aspect, it is possible to adjust how closely the second event follows the first event in accordance with the ratio of the density of music notes involved in the first event to the density of music notes involved in the second event.

Aspect 5

A control method according to the fifth aspect is the control method according to the fourth aspect, wherein in determining the tracking coefficient, causing the tracking coefficient to be greater in a case where the ratio is greater than a predetermined threshold value as compared to a case where the ratio is equal to or smaller than the predetermined threshold value.

According to this aspect, it is possible to adjust how closely the second event follows the first event in accordance with the ratio of the density of music notes involved in the first event to the density of music notes involved in the second event.

Aspect 6

A control method according to a sixth aspect is the control method according to the first aspect, wherein in determining the tracking coefficient, causing the tracking coefficient to be smaller in a case where the second event is related to a main melody as compared to a case where the second event is not related to the main melody.

According to this aspect, it is possible to adjust how closely the second event follows the first event depending on whether the second event is related to the main melody or not.

Aspect 7

A control method according to a seventh aspect is the control method according to the first aspect, wherein in determining the tracking coefficient, determining the tracking coefficient to be a value corresponding to an instruction from a user.

According to this aspect, it is possible to adjust how closely the second event follows the first event in accordance with the user's instruction.

Aspect 8

A control method according to an eighth aspect is the control method according to any one of the first to the seventh aspects, wherein the first event and the second event are each an event in which sound is output in the music performance, and wherein the tracking coefficient indicates either how closely a timing of outputting sound in the second event follows a timing of outputting sound in the first event, or how closely a volume of sound output in the second event follows a volume of sound output in the first event.

According to this aspect, it is possible to adjust how closely the second event follows the first event with respect to the timing of outputting sound or the volume of output sound.

Aspect 9

A control method according to a ninth aspect is the control method according to the first aspect or any one of the third to the seventh aspects, wherein the second event is an event in which sound is output by an automated musical instrument, and wherein the method further includes causing the automated musical instrument to output sound based on the determined operation mode.

According to this aspect, it is possible to adjust how closely the event in which sound is output by the automated musical instrument follows the first event.

Aspect 10

A control method according to a tenth aspect is the control method according to the second aspect, wherein the method further includes determining the tracking coefficient in accordance with a position that is being played in a piece of music.

According to this aspect, it is possible to adjust how closely the second event follows the first event in accordance with the performance position in the piece of music.

Aspect 11

A control method according to an eleventh aspect is the control method according to the second aspect, wherein the method further includes determining the tracking coefficient in accordance with a ratio of a density of music notes involved in the first event to a density of music notes involved in the second event.

According to this aspect, it is possible to adjust how closely the second event follows the first event in accordance with the ratio of a density of music notes involved in the first event to a density of music notes involved in the second event.

Aspect 12

A control method according to a twelfth aspect is the control method according to the second aspect, wherein the method further includes determining the tracking coefficient such that the tracking coefficient is smaller in a case where the second event is related to a main melody as compared to a case where the second event is not related to the main melody.

According to this aspect, it is possible to adjust how closely the second event follows the first event depending on whether the second event is related to the main melody or not.

Aspect 13

A control method according to a thirteenth aspect is the control method according to the second aspect, wherein the method further includes setting the tracking coefficient to a value corresponding to an instruction from a user.

According to this aspect, it is possible to adjust how closely the second event follows the first event in accordance with the user's instruction.

Aspect 14

A control method according to a fourteenth aspect is the control method according to the second aspect or any one of the tenth to the thirteenth aspects, wherein the first event and the second event are each an event in which sound is output in the music performance, and wherein the first state variable and the second state variable are each a variable related to a timing of outputting sound in the music performance or a volume of sound output in the music performance.

According to this aspect, it is possible to adjust how closely the second event follows the first event in accordance with the timing of outputting sound or the volume of output sound.

Aspect 15

A control method according to a fifteenth aspect is the control method according to the second aspect or any one of the tenth to the fourteenth aspects, wherein the second event is an event in which sound is output by an automated musical instrument, and wherein the method further includes causing the automated musical instrument to output sound at a timing determined based on the updated second state variable.

According to this aspect, it is possible to adjust how closely the event in which sound is output by the automated musical instrument follows the first event.

Aspect 16

A controller according to a sixteenth aspect includes: a receiver configured to receive a result of detection related to a first event in music performance; a coefficient determiner configured to determine a tracking coefficient that indicates how closely a second event follows the first event in the music performance; and an operation determiner configured to determine an operation mode of the second event based on the tracking coefficient.

According to this aspect, it is possible to adjust how closely the second event follows the first event.

What is claimed is:

1. A control method comprising:

detecting a first sound of a first event played by a player on a musical instrument with a sensor arranged by the musical instrument;

receiving, at a controller, a result of the detection related to the first event;

determining, using the controller, a tracking coefficient that indicates how closely a second sound to be output during a second event by an automated musical instrument follows the first event in the music performance;

determining, using the controller, an operation mode for outputting the second sound from the automated musical instrument based on the tracking coefficient; and outputting the second sound from the automated musical instrument based on the determined operation mode.

2. A control method comprising:

detecting a first sound of a first event played by a player on a musical instrument with a sensor arranged by the musical instrument;

receiving, at a controller, a first observation value related to the first event in a music performance;

updating, using the controller, a first state variable related to the first event by using the first observation value;

updating, using the controller, a second state variable related to a second event, in which a second sound is output by an automated musical instrument in the music performance by using a product resulting from multiplication of the updated first state variable by a tracking coefficient that indicates how closely the second event follows the first event in the music performance; and outputting the second sound from the automated musical instrument based on the second state variable.

3. The control method according to claim 1, wherein the tracking coefficient is a value corresponding to a position of the music performance in a piece of the music.

4. The control method according to claim 1, wherein the tracking coefficient is a value corresponding to a ratio of a density of music notes involved in the first event to a density of music notes involved in the second event.

5. The control method according to claim 4, wherein the tracking coefficient is greater in a case where the ratio is greater than a predetermined threshold value as compared to a case where the ratio is equal to or smaller than the predetermined threshold value.

6. The control method according to claim 1, wherein the tracking coefficient is smaller in a case where the second event is related to a main melody as compared to a case where the second event is not related to the main melody.

7. The control method according to claim 1, wherein the tracking coefficient is a value corresponding to an instruction from the first user or a second user.

8. The control method according to claim 1, wherein the tracking coefficient indicates either how closely a timing of outputting the second sound in the second event follows a timing of outputting the first sound in the first event, or how closely a volume of the second sound output in the second event follows a volume of the first sound output in the first event.

9. The control method according to claim 2, wherein the tracking coefficient indicates either how closely a timing of outputting the second sound in the second event follows a timing of outputting the first sound in the first event, or how closely a volume of the second sound output in the second event follows a volume of the first sound output in the first event.

10. The control method according to claim 3, wherein the tracking coefficient indicates either how closely a timing of outputting the second sound in the second event follows a timing of outputting the first sound in the first event, or how closely a volume of the second sound output in the second event follows a volume of the first sound output in the first event.

11. The control method according to claim 4, wherein the tracking coefficient indicates either how closely a timing of outputting the second sound in the second event follows a timing of outputting the first sound in the first event, or how closely a volume of the second sound output in the second event follows a volume of the first sound output in the first event.

12. The control method according to claim 5, wherein the tracking coefficient indicates either how closely a timing of outputting the second sound in the second event follows a timing of outputting the first sound in the first event, or how closely a volume of the second sound output in the second event follows a volume of the first sound output in the first event.

13. The control method according to claim 6, wherein the tracking coefficient indicates either how closely a timing of outputting the second sound in the second event follows a timing of outputting the first sound in the first event, or how closely a volume of the second sound output in the second event follows a volume of the first sound output in the first event.

14. The control method according to claim 7, wherein the tracking coefficient indicates either how closely a timing of outputting the second sound in the second event follows a timing of outputting the first sound in the first event, or how closely a volume of the second sound output in the second event follows a volume of the first sound output in the first event.

15. A controller comprising:

a sensor arranged by a musical instrument that detects a first sound of a first event from the musical instrument played by a player;

a receiver configured to receive a result of detection related to the first sound event in a music performance;

a coefficient determiner configured to determine a tracking coefficient that indicates how closely a second sound to be output during a second event by an automated musical instrument follows the first event in the music performance; and an operation determiner configured to determine an operation mode for outputting the second sound from the automated musical instrument based on the tracking coefficient;

wherein the second sound is output by the automated musical instrument based on the determined operation mode.

16. The control method according to claim 1, wherein the sensor is a microphone configured to detect audio.

17. The control method according to claim 2, wherein the sensor is a microphone configured to detect audio.

18. The controller according to claim 15, wherein the sensor is a microphone configured to detect audio.

* * * * *